US006491082B1

(12) United States Patent
Fu

(10) Patent No.: US 6,491,082 B1
(45) Date of Patent: Dec. 10, 2002

(54) SAFETY FOR BLADE OF TAPE DISPENSER

(76) Inventor: Sheng Mei Fu, 3 Fl., No. 3, Alley 318, Long Chiang Rd., Taipei (TW)

( * ) Notice: Subject to any disclaimer, the term of this patent is extended or adjusted under 35 U.S.C. 154(b) by 0 days.

(21) Appl. No.: 10/052,510

(22) Filed: Jan. 23, 2002

(51) Int. Cl.[7] ..... B32B 31/00

(52) U.S. Cl. ..... 156/527; 156/574; 156/576; 156/577; 156/523; 225/20; 225/23; 225/56; 225/59; 225/77; 225/91

(58) Field of Search ..... 225/20, 23, 56, 225/59, 77, 91; 156/574, 527, 523, 576, 577; 29/411, 417, 428; 403/112, 117; 206/389, 411

(56) References Cited

U.S. PATENT DOCUMENTS 5,067,222 A * 11/1991 Frank et al. ..... 29/411
5,393,367 A * 2/1995 Chen ..... 156/523
5,456,790 A * 10/1995 Chen ..... 156/527
5,849,144 A * 12/1998 Tang et al. ..... 156/577
6,039,102 A * 3/2000 Sadrakula et al. ..... 156/510
6,296,033 B1 * 10/2001 Clements ..... 156/527

* cited by examiner

*Primary Examiner*—Linda Gray
(74) *Attorney, Agent, or Firm*—Rosenberg, Klein & Lee

(57) ABSTRACT

A safety for blade of tape dispenser includes a fixing seat provided above a tape roller of the tape dispenser. The fixing seat defines an inner space in which a blade of the tape dispenser is fixedly mounted and a shield plate is disposed above the blade. The shield plate includes two legs configured to have some degree of elasticity and connected at outmost ends to the fixing seat to normally project a front edge of the shield plate beyond a serrated front edge of the blade when the tape dispenser is not in use or is used to apply a length of tape on a surface. When the tape dispenser is used to cut the length of applied tape, the two elastic legs allow the shield plate to slide backward under a tension of the tape to expose the blade for cutting the tape.

2 Claims, 5 Drawing Sheets

SAFETY FOR BLADE OF TAPE DISPENSER

BACKGROUND OF THE INVENTION

The present invention relates to a safety for blade of tape dispenser, and more particularly to a safety on a tape dispenser for shielding a blade of the tape dispenser when the latter is not in use, so that the blade would not injure a user.

In addition to a main body and a tape reel for holding a roll of tape, a conventional tape dispenser typically includes a blade provided at a front end thereof. After a length of tape has been applied on a surface, a handle of the tape dispenser is lifted by a certain angle for the blade to cut the tape. The blade is normally exposed from the tape dispenser and tends to injure a user when the user carelessly contacts with the blade.

SUMMARY OF THE INVENTION

It is therefore a primary object of the present invention to provide a safety for blade of a tape dispenser, so that the blade is properly covered when the tape dispenser is not in use or is used in applying the tape on a surface, protecting a user against unexpected injury by the blade.

The safety for blade of a tape dispenser according to the present invention mainly includes a fixing seat located above a tape roller in front of the tape dispenser. The fixing seat defines an inner space in which the blade of the tape dispenser is fixedly mounted and a shield plate is disposed above the blade. The shield plate includes two legs inclinedly extended from a rear central area toward two lateral sides of the shield plate to have some degree of elasticity. Two outmost ends of the two legs are movably connected to the fixing seat to normally project a front edge of the shield plate beyond a serrated front edge of the blade when the tape dispenser is not in use or is used to apply a length of tape on a surface.

When the tape dispenser is used to cut a length of tape applied on a surface, the two elastic legs allow a tension of the tape to push the shield plate backward to expose the serrated front edge of the blade for cutting the tape.

A slide channel is formed on a top of the fixing seat. An L-shaped holding-down plate of the tape dispenser for holding down the length of tape applied on a surface before the tape is cut with the blade can be easily and quickly assembled to the tape dispenser simply by sliding a lower part of the holding-down plate into the slide channel.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

Figure 1:
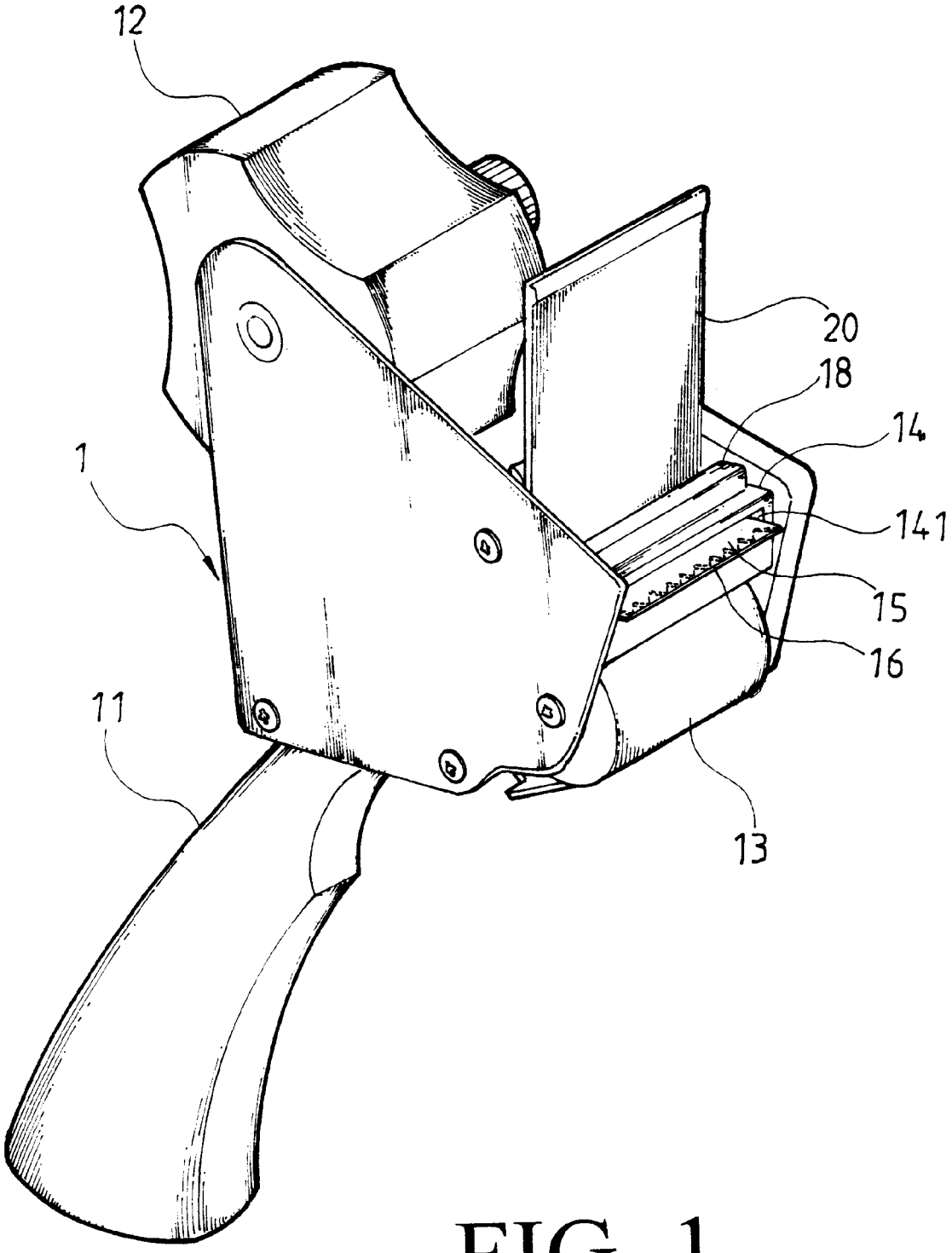
FIG. 1 is an assembled perspective view of a tape dispenser provided with a safety for blade according to the present invention.
Figure 2:
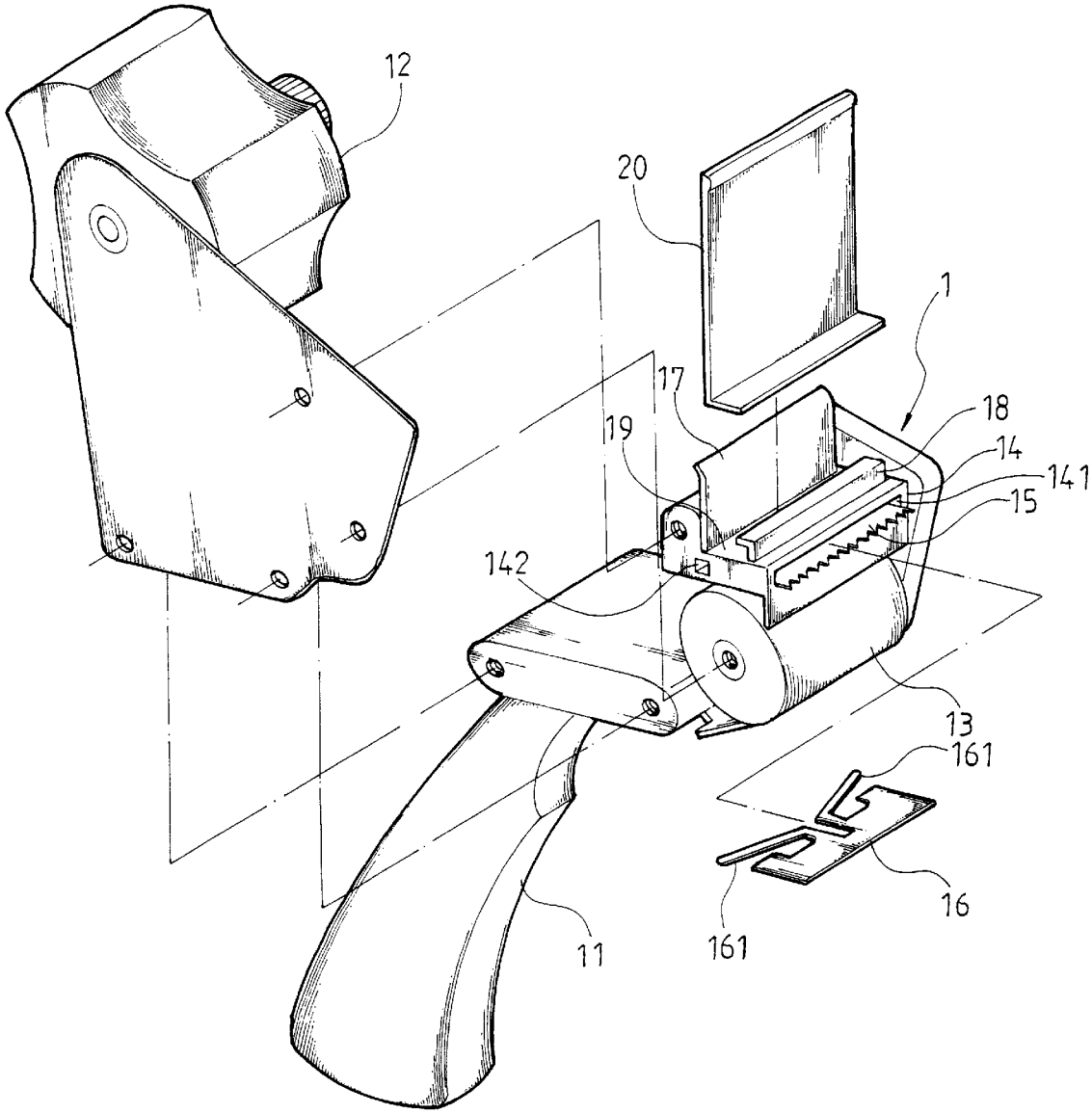
FIG. 2 is an exploded perspective view of FIG. 1.

Please refer to FIGS. 1 and 2 that are assembled and exploded perspective views, respectively, of a tape dispenser 1 having a safety for blade according to the present invention. The tape dispenser 1 has a structure basically the same as that of a conventional tape dispenser to mainly include a handle 11, a tape reel 12 for holding a roll of tape, a roller 13 for dispensing and applying the tape over a desired surface, a blade 15 having a serrated front edge for cutting the dispensed tape, and an L-shaped holding-down plate 20 located above and perpendicular to the blade 15 for holding down the applied tape before cutting the tape with the blade 15.

The safety for blade according to the present invention mainly includes a fixing seat 14 provided on the tape dispenser above the roller 13 and defining an inner space 141. Two fixing holes 142 are separately provided at two side walls of the fixing seat 14 to communicate with the inner space 141. The blade 15 is fixedly mounted in the inner space 141 of the fixing seat 14 with the serrated front edge exposed therefrom. The safety for blade also includes a shield plate 16 that is disposed in the inner space 141 of the fixing seat 14 above the blade 15. The shield plate 16 is integrally provided at a rear edge with two legs 161 that separately inclinedly extend from a rear central area of the shield plate 16 toward two lateral sides thereof, so that the two legs 161 have a certain degree of elasticity. When the shield plate 16 is set in the inner space 141, outmost ends of the two legs 161 are received in and press against the two fixing holes 142 to fix the shield plate 16 in the fixing seat 14. The two legs 161 are so configured that a front edge of the shield plate 16 set in the inner space 141 is normally projected beyond the serrated front edge of the blade 15.

A stopper 17 and a rail 18 in the shape of an inverted letter L are provided on a top of the fixing seat 14 to provide a sliding channel 19 between them. The L-shaped holding-down plate 20 can be more easily and quickly assembled to the tape dispenser 1 simply by sliding a lower part of the holding-down plate 20 into the sliding channel 19.

Figure 3:
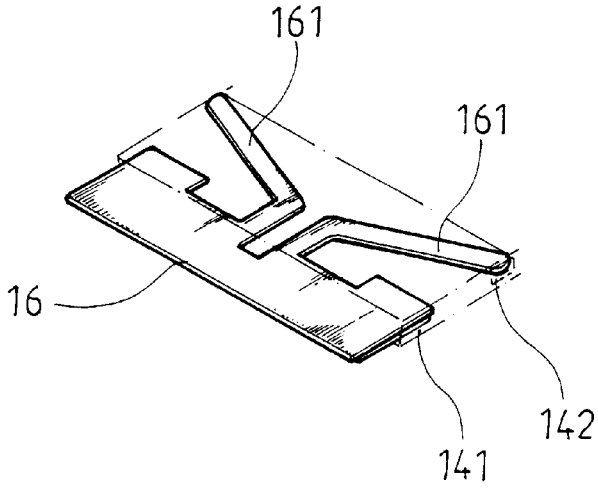
FIGS. 3 and 4 show movements of a shield plate included in the safety for blade of tape dispenser according to the present invention.
Figure 5:
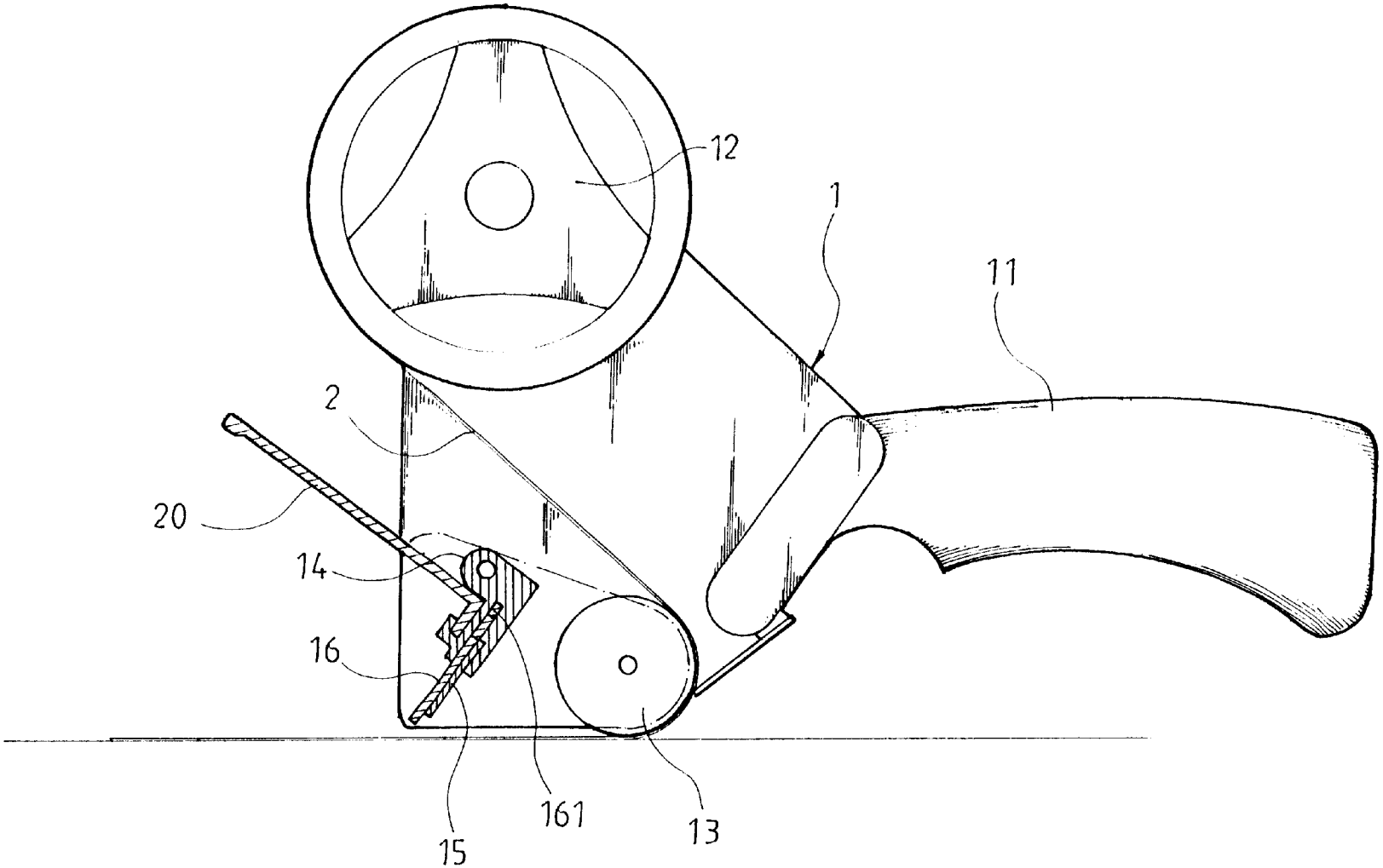
FIGS. 5 and 6 show positions of the shield plate of the safety of the present invention when the tape dispenser of FIG. 1 is in use to apply and cut a length of tape, respectively.

Please refer to FIGS. 3 and 5 at the same time. When the tape dispenser 1 is not in use or is used to apply a length of tape 2 over a desired surface, the tape 2 is extended from the tape reel 12 to pass below the roller 13 for applying on the desired surface without contacting with the outward projected shield plate 16, and the shield plate 16 stays at the projected position to cover the serrated front edge of the blade 15, preventing a user from being injured by the blade 15.

Figure 4:
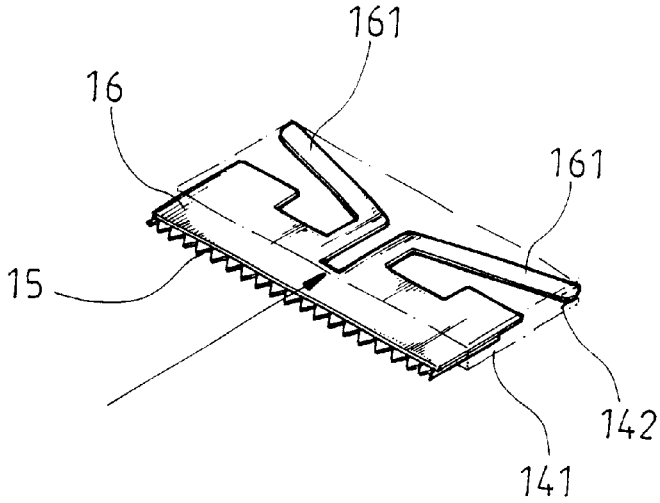
Figure 6:
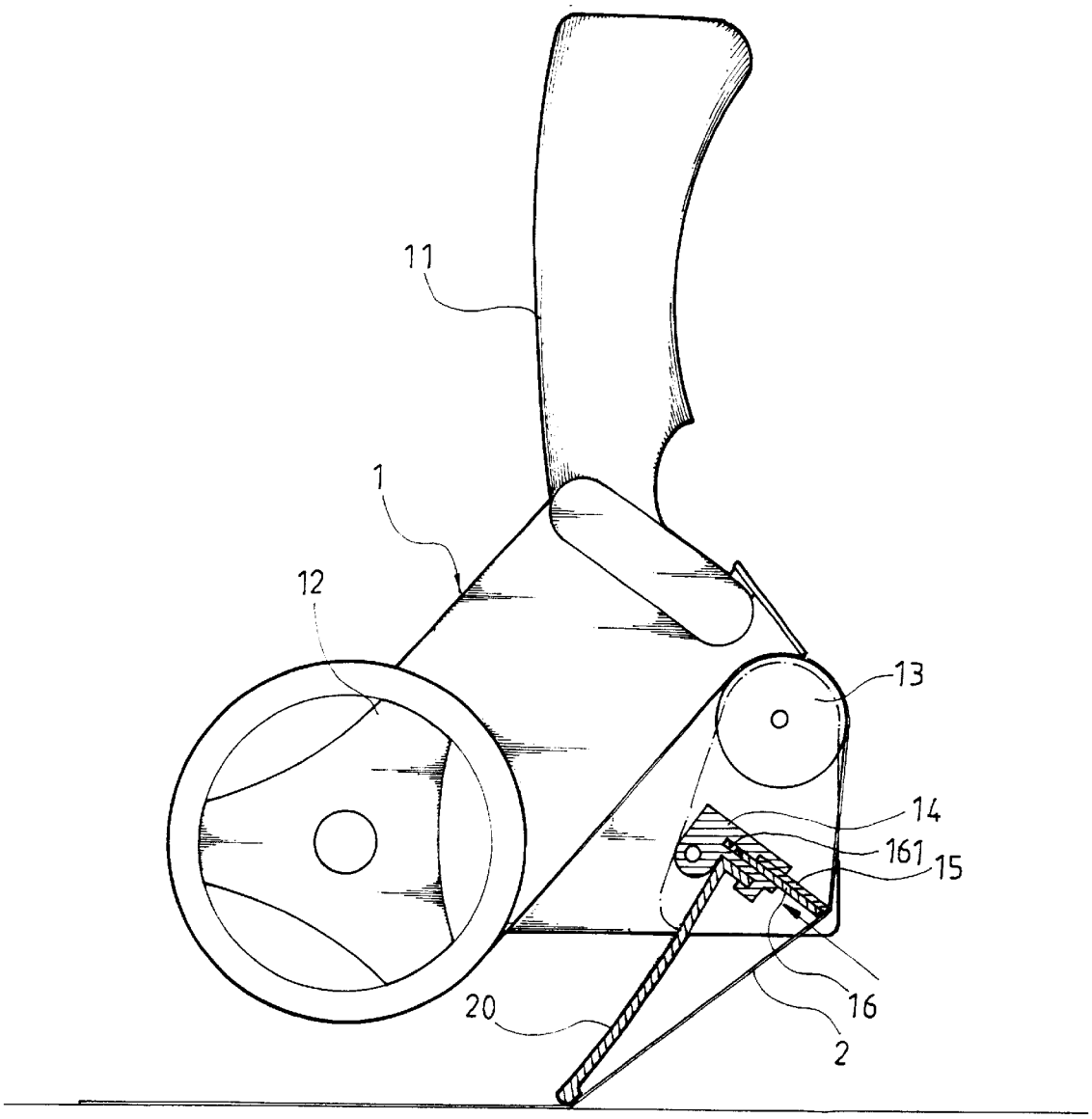

When the tape 2 has been applied on the desired surface, the user would have to lift the handle 11 of the tape dispenser 1 for the holding-down plate 20 to point downward and press against the tape 2 applied on the desired surface before cutting the tape 2 with the blade 15. At this point, a section of the tape 2 between the holding-down plate 20 and the roller 13 is tensioned by a certain degree to get in contact with the front edge of the shield plate 16 and compress the legs 161. Due to the elasticity of the legs 161, the shield plate 16 is adapted to slide backward under a force from the tensioned tape 2 to expose the serrated front edge of the blade 15, as shown in FIGS. 4 and 6. The exposed serrated front edge of the blade 15 cuts the tape 2 to complete the application of the tape 2 to the desired surface. When the tape 2 has been cut, it no longer applies any force on the shield plate 6. At this point, the elasticity of the compressed legs 161 restores the shield plate 16 to the forward projected position to cover the serrated front edge of the blade 15 again.

The safety of the present invention enables the blade 15 of the tape dispenser 1 to be properly covered by the shield plate 16 when the tape dispenser 1 is not in use or is used in applying a length of tape 2 on a surface, the tape dispenser is therefore more practical and safer for use.

What is claimed is:

1. A safety for blade of tape dispenser, said tape dispenser including a handle, a tape reel for holding a roll of tape, a roller for dispensing and applying a length of said tape over a desired surface, a blade having a serrated front edge for cutting said dispensed tape, and an L-shaped holding-down plate located above said blade for holding down said tape applied on said desired surface before said tape is cut with said blade, said safety comprising:

a fixing seat being mounted on said tape dispenser above said roller and defining an inner space, two fixing holes being provided at two side walls of said fixing seat to communicate with said inner space; said blade being fixedly mounted in said inner space with said serrated front edge exposed from said fixing seat; and a shield plate being disposed in said inner space of said fixing seat above said blade; said shield plate being integrally provided at a rear edge with two legs that inclinedly extend from a rear central area of said shield plate toward two lateral sides of said shield plate to have some degree of elasticity; outmost ends of said two legs being received in and pressing against said two fixing holes to locate said shield plate in said inner space with a front edge thereof normally projected beyond said serrated front edge of said blade, such that when said tape dispenser is not in use or is used to apply a length of said tape on a desired surface, said front edge of said shield plate at said projected position is not in contact with said tape, and when said tape dispenser is used to cut said tape applied on said desired surface, said projected shield plate is in contact with said tape and said two elastic legs allow said shield plate to slide backward under a force from said tape and to expose said serrated front edge of said blade for cutting said tape.

2. The safety for blade of tape dispenser as claimed in claim 1, further comprising a stopper and a rail in the shape of an inverted letter L provided on a top of said fixing seat to define a slide channel between them, and said L-shaped holding-down plate being conveniently assembled to said tape dispenser by sliding a lower part of said holding-down plate into said slide channel.

* * * * *